US007581733B2

(12) United States Patent
Branch et al.

(10) Patent No.: US 7,581,733 B2
(45) Date of Patent: Sep. 1, 2009

(54) ARCHERY TARGET AND RELATED METHOD OF MANUFACTURE

(75) Inventors: Kelly J. Branch, Stevensville, MI (US); LaVerne B. Keson, Benton Harbor, MI (US); Chad E. Hartline, Baroda, MI (US)

(73) Assignee: All Seasons Archery, Inc., St. Joseph, MI (US)

( * ) Notice: Subject to any disclaimer, the term of this patent is extended or adjusted under 35 U.S.C. 154(b) by 0 days.

(21) Appl. No.: 11/877,092

(22) Filed: Oct. 23, 2007

(65) Prior Publication Data

US 2008/0099997 A1 May 1, 2008

Related U.S. Application Data

(60) Provisional application No. 60/862,871, filed on Oct. 25, 2006.

(51) Int. Cl.
*F41J 3/00* (2006.01)

(52) U.S. Cl. ..... 273/408

(58) Field of Classification Search ..... 273/403, 273/404, 407, 408; 297/440.15, 218.3, 451.13
See application file for complete search history.

(56) References Cited

U.S. PATENT DOCUMENTS

| | | | | | |
|---|---|---|---|---|---|
| 3,170,729 | A * | 2/1965 | Grant | 297/440.15 |
| 3,902,721 | A | 9/1975 | Piccini | |
| 4,042,240 | A * | 8/1977 | Kinart | 273/404 |
| 4,235,444 | A * | 11/1980 | Meyer | 273/403 |
| 4,695,060 | A | 9/1987 | Pilgrim | |
| 4,813,684 | A * | 3/1989 | Bruno | 273/403 |
| 5,002,285 | A * | 3/1991 | Morrell | 273/408 |
| 5,290,042 | A * | 3/1994 | Worley et al. | 273/408 |
| 5,354,066 | A * | 10/1994 | Swanson et al. | 273/408 |
| 5,427,382 | A * | 6/1995 | Pate et al. | 273/403 |
| 5,465,977 | A * | 11/1995 | Mann | 273/408 |
| 5,477,891 | A | 12/1995 | Benesi | |
| 5,649,708 | A | 7/1997 | Podlesny | |
| 6,068,261 | A | 5/2000 | Nettle | |
| 6,409,264 | B1 * | 6/2002 | Palmer et al. | 297/218.3 |
| 6,799,764 | B2 | 10/2004 | Ingold | |
| 6,926,281 | B1 * | 8/2005 | Woock | 273/403 |
| 2004/0007819 | A1 * | 1/2004 | Twichell | 273/404 |
| 2006/0157938 | A1 * | 7/2006 | Box et al. | 273/403 |
| 2006/0202425 | A1 * | 9/2006 | Pulkrabek | 273/404 |
| 2007/0029733 | A1 * | 2/2007 | Anderson | 273/408 |

* cited by examiner

*Primary Examiner*—Mark S Graham
(74) *Attorney, Agent, or Firm*—Warner Norcross & Judd LLP

(57) ABSTRACT

An archery target including a rigid frame including a target side, a sheet secured to the frame on a target side to create an interior compartment bounded by the sheet and the frame, a compressed density material in the compartment and a backing. The sheet can be a filtration screen constructed from synthetic polymers, optionally polyamide fibers, and can have a weight of 13 to 16 ounces per square yard, and can include parallel warp yarns formed from three pairs monofilament polyamide fibers, the three pairs of fibers twisted together to form a cable yarn, as well as parallel fill yarn formed from a single monofilament polyamide fiber. A related method includes: providing a rigid frame; securing a sheet to the frame to create an interior compartment; compressing a density material; and securing a backing to the frame.

23 Claims, 4 Drawing Sheets

ARCHERY TARGET AND RELATED METHOD OF MANUFACTURE

This application claims benefit of U.S. Provisional Application 60/862,871, filed Oct. 25, 2006, which is hereby incorporated by reference.

BACKGROUND OF THE INVENTION

The present invention relates to targets, and more particularly, to multi-layered, durable archery targets.

Archery targets come in a variety of configurations. Most targets are designed to: (a) safely stop and retain arrows; (b) facilitate arrow extraction; and (c) be relatively low in cost, durable and easily maintained. Where targets are used by multiple users at archery ranges and/or pro shops, or implemented in testing procedures by archery component manufacturers, the foregoing design objectives are especially important.

Two primary targets are in use today. The first is what is referred to as a "bag target," which generally includes a burlap or plastic exterior in the shape of a bag. The exterior includes one or more target faces. An internal batting is stuffed into the interior of the bag. Bag targets usually include a hanger or a support rod protruding from the top or sides of the bag, respectively, to support it.

Although the bag target is generally suitable for occasional use, with extended use and multiple shots, the burlap and internal batting quickly wears out, which reduces the effectiveness of the target's arrow-stopping ability. More specifically, the individual woven strands of the burlap target face tend to be impacted by the point of arrow. After multiple impacts, individual strands are abraded, eventually causing the strand to break into two or more separate sections, which deteriorates the target face. Further, with conventional exteriors, the individual strands tend to separate after penetration by an arrow, and stay separated. If this occurs repeatedly, the strands can separate enough to create a hole through which the batting can fall out of the bag, thereby reducing the effectiveness of the bag target. Finally, some conventional bag targets tend to be less capable of quickly stopping arrows shot from faster-shooting, modern archery bows.

A second, primary type of target is referred to as a "layered foam target." In this construction, thin layers or sheets of foam are placed atop one another to form a cube of the layered foam. The cube includes a metal band or a plastic film that wraps tightly around the foam layers to compress the foam sheets and hold them together. The completed cube includes a target face formed by the ends of the foam sheets. Although this construction proves to be somewhat better at stopping high speed arrows than conventional bag targets, it tends to wear out because the impact of arrows striking the target face damages the individual layers of foam, and after time, creates holes in the target face. Moreover, with some extremely fast arrows shot from modern bows, the foam can melt on the arrow, which can change its trajectory and thus decrease shooting accuracy.

In view of conventional archery targets, there exists a long-felt, unsolved need to provide an arrow target that is durable, that includes a quickly and repeatedly healing target face, and that can stop very fast arrows.

SUMMARY OF THE INVENTION

The present invention is directed to an archery target including a rigid, structural frame including a target side, a sheet secured to the frame on a target side to create an interior compartment bounded by the sheet and the frame, a compressed density material located within the compartment, and a backing.

In one embodiment, the sheet can be a filtration screen constructed from synthetic polymers, optionally polyamide fibers.

In another embodiment, the filtration screen can have a weight of 13 to 16 ounces per square yard. Optionally, the filtration screen can be constructed from a woven fabric including a plurality of parallel warp yarns formed from three pairs of 4 mil to 12 mil monofilament polyamide fibers, the three pairs of fibers twisted together to form a cable yarn. Further optionally, the woven fabric can include a plurality of parallel fill yarns, the fill yarns formed from a single 8 mil to 20 mil monofilament polyamide fiber.

In yet another embodiment, the sheet can be secured to the frame in a stretched state so that the sheet forms a substantially planar target face of the target. Optionally, the sheet can be secured to the frame with at least two side by side rows of staples, the staples of one row staggered from the staples of another row.

In a further embodiment, the density material is a fibrous material, optionally a fibrous polyester. The polyester can be compressed into the frame in such a manner so as to have a density of about 8 to about 20 pounds per cubic foot within the interior compartment, optionally about 10 to about 14 pounds per cubic foot within the interior compartment, further optionally about 12 pounds per cubic foot within the interior compartment.

In yet a further embodiment, a method for manufacturing an archery target is provided including: providing a rigid, structural frame; securing a sheet to the frame to create an interior compartment bounded by the sheet and the frame; compressing a density material; and securing a backing to the frame. Optionally, the sheet and density material can have the constructions or characteristics noted in the embodiments above.

The present invention provides an effective, durable, low cost archery target that overcomes the significant limitations of previous archery targets. The target sheet is constructed from a material that is extremely durable and self healing. Because of the durable nature of the material, the target face requires minimal maintenance and can withstand tens of thousand of shots. This decreases the overall cost to the owner of the target in replacement components and target down time. The compression of the density material also provides stored energy that quickly and efficiently stops arrows, yet facilitates easy arrow removal—in some cases, less than 2 to 5 pounds of force is required to remove an arrow from the target. Moreover, with the improved stopping power, over penetration of arrows is reduced, which preserves the useful life of fletchings on those arrows.

These and other objects, advantages and features of the invention will be more readily understood and appreciated by reference to the detailed description of the invention and the drawings.

DETAILED DESCRIPTION OF THE INVENTION

Figure 1:
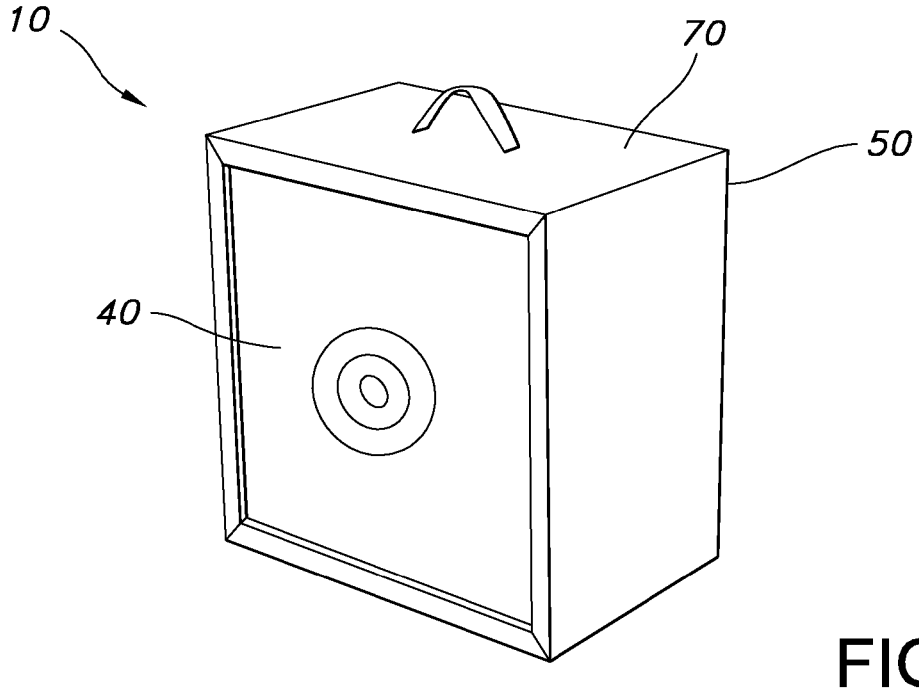
FIG. 1 is perspective view of an archery target of the present invention.

An archery target in accordance with an embodiment of the present invention is shown in FIG. 1, and generally designated 10. The archery target generally includes a frame 20, density material 30, a target side sheet 40 and a backing 50. The frame 20, sheet 40 and backing 50 cooperate to define an interior compartment 60, in which the density material is contained in a compressed state. Although the present invention is described in connection with targets designed to be shot by archery arrows, this description is made for disclosure purposes only and is not intended to limit the invention to only archery targets.

Figure 2:
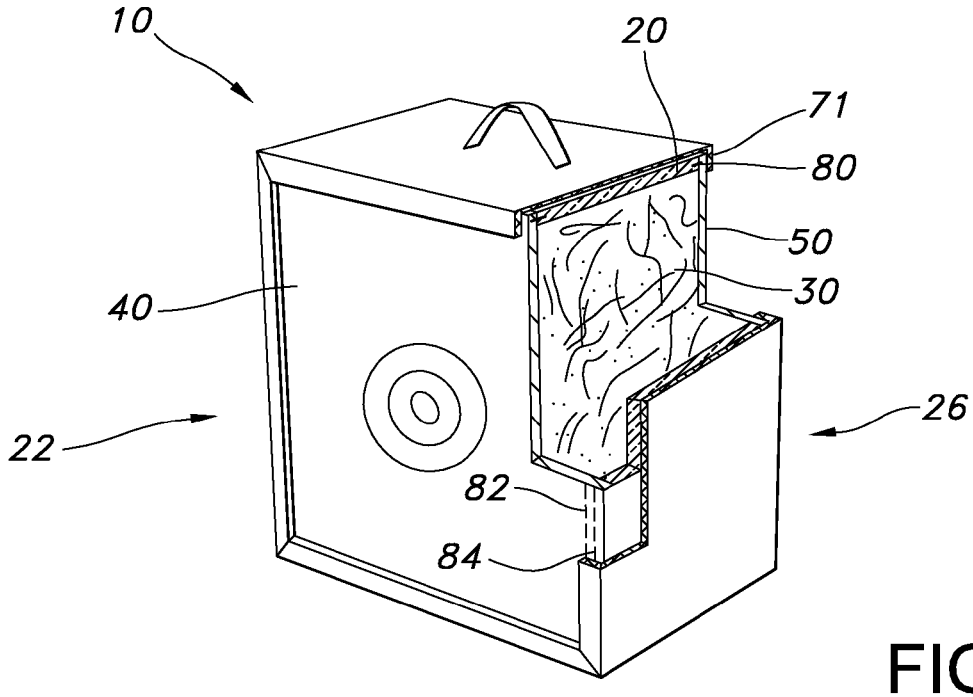
FIG. 2 is a perspective, broken view thereof.
Figure 3:
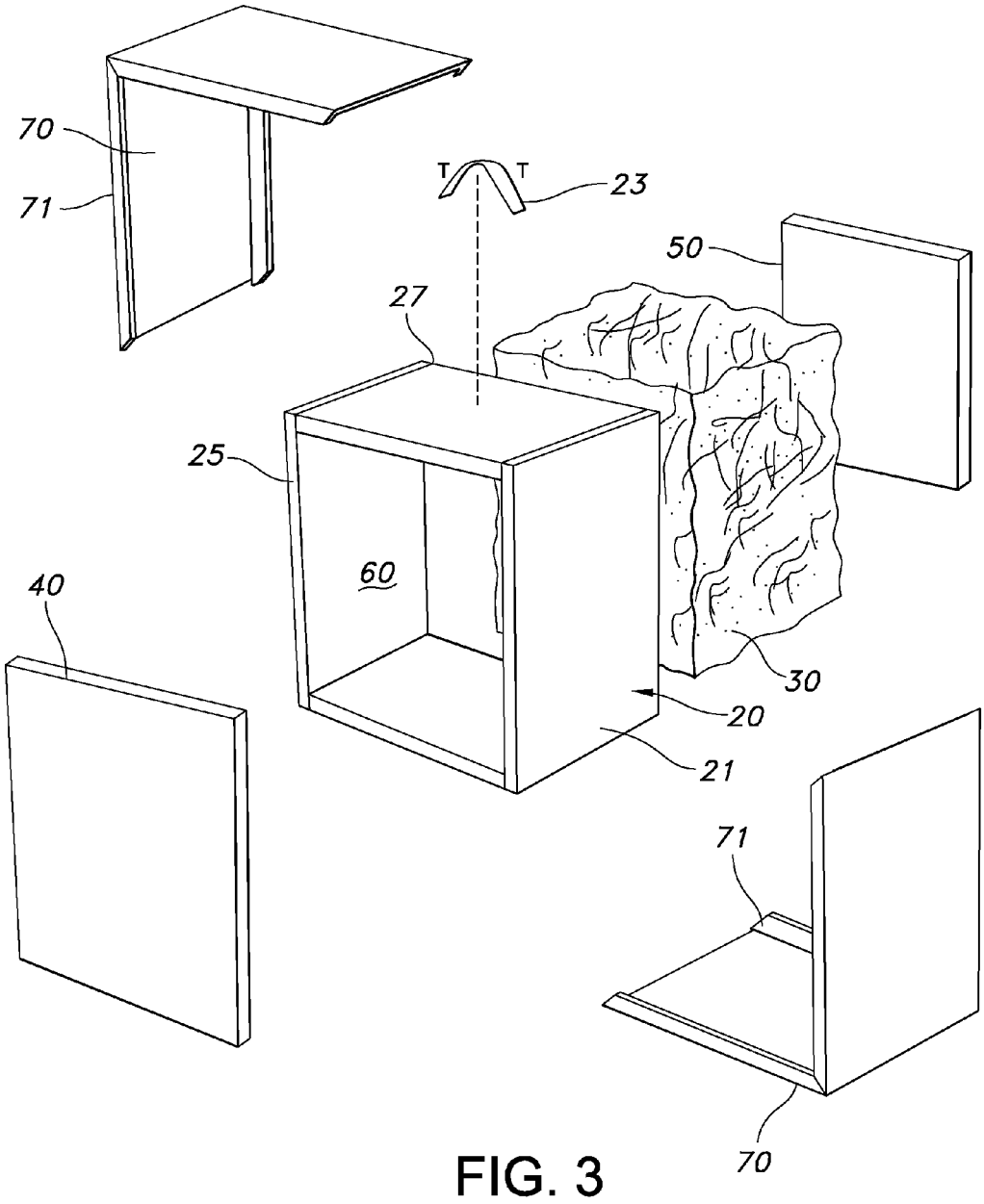
FIG. 3 is a perspective, exploded view thereof.

The components of the archery target 10 will now be described in more detail. As shown in FIGS. 1-3, the frame 20 is generally the shape of a square or rectangle; however, that this frame may be formed in other geometric shapes, for example, a circle, an ellipse, a triangle, a trapezoid and the like. The frame can include a plurality of sidewalls 21, joined together at their ends. The sidewalls may be joined with fasteners, such as nails, tacks, wire, staples screws and the like, or adhesives such as glue. Alternatively, the sidewalls may be integrally molded together as a single unit. The sidewalls 21 can be constructed from a rigid, substantially inflexible material, such as wood, but other material such as plastic, steel, composites, and the like may be used as desired.

In the embodiment shown, the frame can be of a configuration so that it is able to free stand on one of its sidewalls, that is, the frame is able to self-support itself in an upright, vertical orientation so that the target side 22 of the frame faces an archer opposite the target side is the rear side 26. Suitable width dimensions for a bottom sidewall for this configuration range from about 4" to about 18", optionally about 8" to about 12", and further optionally about 10". The embodiment shown can come in a variety of overall dimensions as well, for example 24"×24"×10" and 24"×18"×12".

The target side 22 can be bounded by a front perimeter 25; and the rear side can be bounded by a rear perimeter 27. These perimeters can generally be in the shape of the frame. The perimeters can also be of a thickness so as to receive and hold fasteners driven into or otherwise connected to the perimeters (or optionally other portions of the frame) to secure the sheet 40 to the frame. As shown, the fasteners are about ¼" to about 2½" thick, but other dimensions can be used as desired. Indeed, the perimeters can be very thin, so that the sheet wraps around them onto the sides of the sidewalls 21 and is secured directly to those sides with fasteners or clamping mechanisms.

The frame 20 defines an interior compartment 60 in which density material 30 is positioned. The density material 30 can be a compressed fibrous material ranging in density from about 8 to about 20 pounds per cubic foot within the interior compartment, optionally about 10 to about 14 pounds per cubic foot within the interior compartment, further optionally about 12 pounds per cubic foot within the interior compartment. The fibrous material can be filaments, strand and/or fibers of polyester, polypropylene, and/or other natural or synthetic fibers. Alternatively, the density material can be machined synthetic waste that is compacted and captured within the interior compartment 60. The density material can also be any other suitable compressed fibrous material, or solid material such as foam, polyurethane, polypropylene, polyethylene, cotton, ethyl vinyl acetate, or any other suitable batting or target material.

Within the archery target 10, the density material 30 is in a compressed state. For example, in one embodiment, if the density material was removed from the target, it could expand to a volume of 2, 3, 4, 5, 6, 7, 8, 9, 10, 20 and optionally 30 times the volume of the interior compartment. In this uncompressed state, the density material 30 can have a density of about 0.2 to about 4 pounds per cubic foot.

The archery target also can include a cover 70, as shown in FIGS. 2 and 3. The cover 70 can substantially coextensive with the sidewalls 21 of the frame 20. The cover 70 can be constructed from decorative corrugated plastic, cardboard, wood, metal and other synthetic materials. In one embodiment, the cover covers the sidewalls 21. It also can include flanges 71 that wrap around a portion of the front and rear perimeters of the frame 20. Where it does this, it can conceal any fasteners 80 that are used to secure the sheet 40 or the backing 50 to the frame, if desired.

The target sheet 40 can be secured to the frame in a variety of manners. As shown, however, it is secured with fasteners, such as staples, entirely around the front perimeter 25 of the frame. In other words, there are no gaps between independent fasteners around the perimeter of the frame. The fasteners 80 optionally can be aligned in two or more parallel, side-by-side rows 82, 84. The individual staples of the rows can also be staggered or offset from one another around that perimeter to ensure adequate penetration into the frame 20. When the sheet is fastened to the frame 20, the sheet can be drawn taut across the frame so that no wrinkles or deformations in the sheet are readily visible. This can be done manually or via a mechanical stretching apparatus. Also, the sheet can be drawn taut enough so that it remains substantially planar, that is, it includes very little to no bulge outward, even with the density material compressed within the frame. Optionally, the sheet can be secured to the frame with devices other than staples, such as large headed nails, truss connectors, glue and the like.

Alternatively, to secure the sheet 40 to the frame 20, the frame can define a groove (not shown), and the sheet 40 can interfit within the groove. An assembly (not shown) including a projection (not shown) can be placed over the sheet in the groove, and forced into the groove to stretch the sheet over the frame.

The target sheet 40 can be constructed from an industrial sheet material. One specific material suitable for being the target sheet is a filtration screen. Filtration screens are constructed from a screen fabric having mesh openings from 10,000 microns down to openings as small as 1 micron. The screens are available in polyamide (Nylon), polyester, polypropylene, PTFE or in other synthetic fibers. Filtration screens are used to act as a filter, capturing solids from a slurry, while permitting fluids from the slurry to flow through the screen. One specific example of a material suitable for use as a target sheet 40 is identified under the trademark Filtratex®, and identified as a 191-010 sheet, which is commercially available from Crosible Filtration, Inc., of Arlington, Tex., which has many of the characteristics that are set forth in the description that follows.

Figure 4:
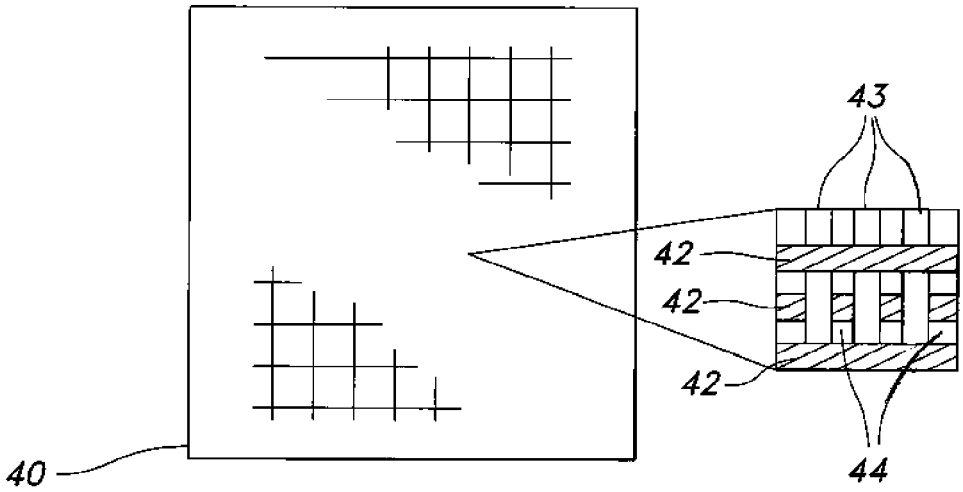
FIG. 4 is a view of a sheet thereof.

The target sheet 40 can be constructed from a nylon (polyamide) or comparable synthetic material fibers and can include a modified satin weave. Other weaves can be substituted as desired. The sheet can have a thread count of 36 ("warp")×35 ("fill" or "weft") per inch. The terms used to describe the sheet 40 here, for example, warp and weft etc., are well known in the fabric field, and will only be illustrated briefly here and at FIG. 4. There, the warp 42 and weft 43 dimensions, along with openings 44 therebetween, are shown in a magnified view. Incidentally, it is of no consequence whether the warp 42 or weft 43 are oriented vertically or horizontally when the sheet 40 is installed on the target 10.

Figure 5:
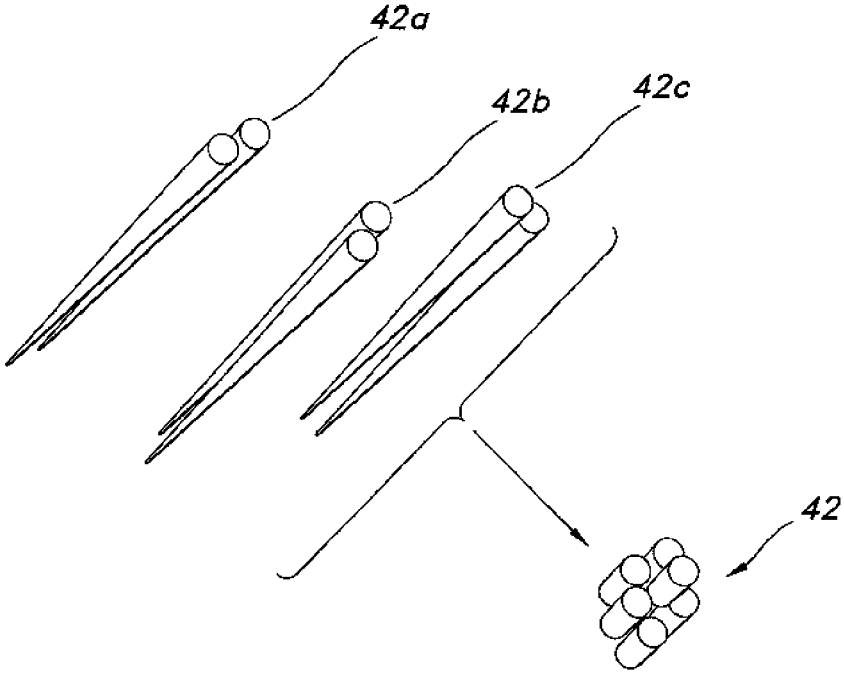
FIG. 5 is a view of fibers included in the sheet.

The thread count of the sheet 40 can vary from 16 (warp)× 15 (weft) per inch to about 41 (warp)×40 (weft) per inch and any increments therebetween. The warp yarn 42 optionally can comprise a cable yarn including three pairs 42*a*, 42*b*, 42*c* of monofilaments. The warp yarn monofilaments can be 8 mils, but can vary from about 4 mils to about 12 mils. Each individual monofilament of a pair can be twisted together. There can be three pairs of twisted monofilaments per warp yarn 42; and these three pairs can be twisted together to form the resulting cable yarn (FIG. 5). The cable yarn can be constructed so that it includes six turns per linear foot, and so that the return cable yarn can include five turns per linear foot (for example, 2×3, 6Z×5S). The weft or fill yarn 43 used in the sheet can be a monofilament of approximately 15 mils. This fill yarn 43 monofilament can vary from about 8 mils to about 20 mils.

The weight of the sheet 40 can be about 15.5 ounces per square yard, but can vary from about 10 ounces per square yard to about 25 ounces per square yard. The finish of the sheet can be Greige and the width can be 24 inches, but can vary from 5 inches to about 200 inches. The standard tolerance of all the above parameters can be 10 percent unless otherwise indicated.

It is believed that the above noted filtration screens are more durable than conventional screens because when shot with field tipped arrows, the arrow tips merely further open the openings 44 between individual cables and/or fibers, rather than contact, abrade and destroy the cables and/or fibers themselves. Moreover, when the arrow is removed, the fibers readily come together and re-close the arrow hole in the sheet. Accordingly, the material will not degrade as it would if it was penetrated and torn by a tip of an arrow.

Further, when a filtration screen is used as a target sheet 40, unexpected results are yielded. For example, conventional archery target manufacturing techniques teach toward conventional woven fabrics that function as textiles, such as burlap and utility grade woven polypropylene—thus, effectively teaching away from a screen material used for a completely different function, namely, to act as a filter, capturing solids from a slurry, while permitting fluids from the slurry to flow through the screen.

The backing 50 can be secured to the rear perimeter 27 of the frame in the same manner as described above in connection with the sheet 40. The backing can be constructed from the same material as the sheet 40, or it can be constructed from other woven materials, fabrics, or plastic materials, or other materials different from that of the sheet 40.

To the frame 20, as shown in FIG. 3, a handle 23 or other attachment to facilitate carrying can be attached. The handle 23 can be constructed from leather, plastic, wood, metal and other materials as desired.

METHOD OF MANUFACTURE

Figure 6:
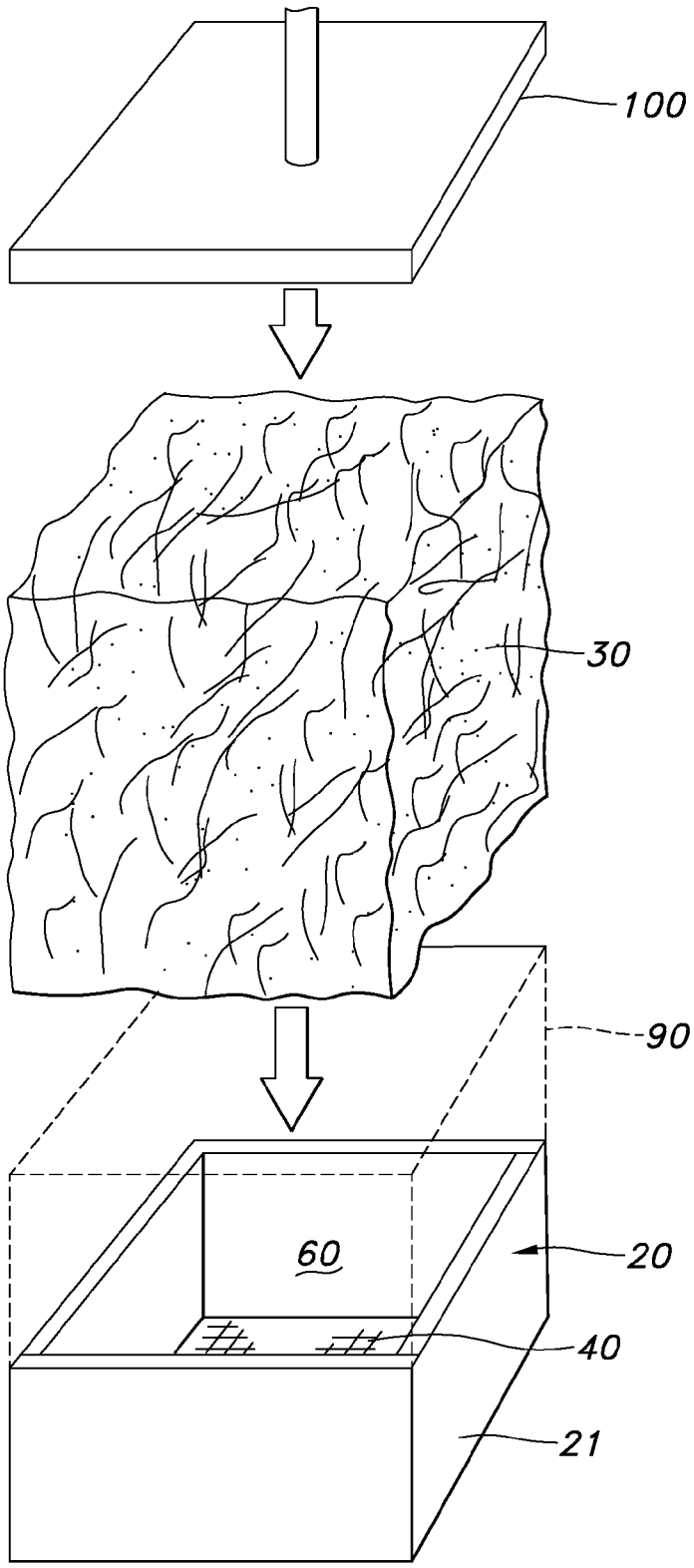
FIG. 6 is a perspective view of the archery target being manufactured.

With reference to FIGS. 1, 3 and 6, a method for assembling the archery target 10 will now be described. The frame 20 is constructed by fastening the sidewalls 21 together. Where the sidewalls are integral with one another, this step can be eliminated.

With the frame 20 constructed, the sheet 40 can be secured to the frame 20 to define an interior compartment 60. The sheet 40 can be joined with the frame 20 with fasteners, such as staples 80. The staples 80 can be aligned in two or more parallel, side by side rows 82, 84. The individual staples of the rows can also be staggered or offset from one another around that perimeter to ensure adequate penetration into the frame 20. As the sheet is fastened to the frame 20, the sheet can be drawn taut across the frame to attain a stretched state wherein no wrinkles or sags in the sheet exist. This can be done manually or via a mechanical stretching apparatus. Any excess portions of the sheet that extend beyond the frame 20 undesirably can be trimmed or secured. Optionally, the excess portion can be trimmed with scissors or a hot knife.

With reference to FIG. 6, a guide assembly 90 can be placed adjacent the frame, so that the opening of the guide assembly is contiguous with the interior compartment 60, which as shown, opens upward. The density material 30—in an uncompressed state—can be placed in the container created by the guide assembly 90 and the interior compartment 60, optionally with a portion of the volume extending out of the container (not shown). A hydraulic jack 100 or other compression device can be used to exert significant force and compress the density material 30 into the interior compartment 60. Alternatively, the density material can be pre-compressed an simply placed in the interior compartment 60 as desired.

After the density material 30 is located in the interior compartment, the backing 50 can be secured to the frame 20 with fasteners as described above. Accordingly, the density material is captured and compressed within the target 10.

In another step, additional finishing tasks can be performed. For example, the cover 70 can be joined with the sidewalls 21 of the frame 20. The cover flanges 71 can be wrapped around a portion of the front and rear perimeters of the frame 20 to conceal any fasteners 80 that are used to secure the sheet 40 or the backing 50 to the frame. A handle 23 optionally can be joined with the target as desired. The sheet 40 and backing 50 can be silk screened with indicia as desired. With the target 10 completed, it can be further processed for shipping.

EXAMPLES

The following are examples of the performance of a target made according to the present invention. These examples are intended to be illustrative only, and in no way limit the scope of the invention.

Example 1

In this example, a target included a target sheet which was a Filtratex® 191-010 filtration screen, and a density material compressed to about 12 pounds per cubic foot. The target 10 was shot about 55,000 times from a distance of 10 feet with arrows shot at 200-400 feet per second, with an arrow grouping of 8 inches, before product failure. Product failure included the target sheet having openings in the target face that were large enough for significant amounts of compressed density material to exit through the hole. This was a significant improvement over the performance of a conventional layered foam target, which needed to be replaced on average after only several thousand shots in a period of about 10 days.

Example 2

In this example, a target such as that used in Example 1 was used. A carbon arrow was shot into the target at about 305 feet per second. Removal of the arrow from the target, however, required only about 1.5 to about 2.5 pounds of force. This amount of force is significantly less than other advertised arrow removal forces, around 24 pounds, for some conventional layered foam targets.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A method for making an archery target comprising:

providing a plurality of rigid structural sidewalls, the sidewalls joined with one another to form a frame defining an interior and including a front perimeter and a rear perimeter;

securing a filtration screen in a stretched state to the front perimeter, the screen having a weight of 13 to 16 ounces per square yard, the filtration screen constructed from a woven fabric including a plurality of parallel warp yarns formed from three pairs of 4 mil to 12 mil monofilament polyamide fibers, the three pairs of fibers twisted together to form a cable yarn, the woven fabric including a plurality of parallel fill yarns, the fill yarns formed from a single 8 mil to 20 mil monofilament polyamide fiber;

positioning the frame adjacent a guide assembly that is contiguous with the interior of the frame;

placing a density material in the interior of the frame and in the guide assembly;

compressing the density material so that the density material moves through the guide assembly and is positioned substantially only in the interior of the frame; and securing a backing to the rear perimeter of the frame to maintain the density material in a compressed state having a density of 8 to 14 pounds per cubic foot within the interior of the frame;

wherein at least one of the sidewalls of the frame is dimensioned to support the frame in an upright orientation, whereby the filtration screen is adapted to face a user who desires to shoot a projectile at the target.

2. The method of claim 1 wherein a portion of at least one of the filtration screen and the backing extends beyond at least one of the front perimeter and the rear perimeter respectively, and further comprising cutting at least one of the filtration screen and the backing to remove the portion of the at least one of the filtration screen and the backing.

3. The method of claim 2 wherein said cutting comprises cutting the filtration screen with a hot knife.

4. The method of claim 3 wherein said securing the filtration screen to the front perimeter of the frame includes stapling the filtration screen to the front perimeter with at least two rows of side by side, staggered staples.

5. The method of claim 4 comprising securing a decorative cover to the frame and over a portion of the front perimeter and the rear perimeter to conceal the sidewalls and the staples.

6. The method of claim 5 wherein the plurality of sidewalls include a bottom sidewall and an upper sidewall, wherein the bottom sidewall is at least 8 inches in depth, whereby the target will remain upright after being shot with an archery arrow.

7. The method of claim 6 comprising attaching a handle to the upper sidewall.

8. The method of claim 7 wherein the sidewalls are constructed from wood.

9. The method of claim 1 comprising printing indicia on the filtration screen.

10. A method for manufacturing an archery target comprising:

providing a rigid, structural frame including at least one sidewall, a target side and a back side;

securing a sheet to the target side to create an interior compartment bounded by the sheet and the frame, the sheet being adapted to be at least partially penetrated by an arrow traveling at a speed of about 200 to about 400 feet per second, the sheet having a weight of about 10 ounces per square yard to about 25 ounces per square yard, the sheet including a plurality of warp elements and a plurality of weft elements, the warp elements including a plurality of filaments twisted to form a cable;

compressing a density material, with the compressed density material being located in the compartment and having a density of about 10 to about 14 pounds per cubic foot within the interior compartment, the density material adapted to prevent the arrow from penetrating the target to an extent that fletchings of the arrow are damaged;

securing a backing adjacent the density material to retain the density material within the compartment.

11. A method for manufacturing an archery target comprising:

providing a rigid, structural, freestanding frame including at least one sidewall, a target side and a back side;

securing a sheet to the target side to create an interior compartment bounded by the sheet and the frame;

compressing a fibrous density material, with the compressed density material being located in the compartment and having a density of about 10 to about 14 pounds per cubic foot within the interior compartment;

securing a backing to the back side to retain the fibrous density material within the compartment;

wherein the sheet is a filtration screen having a weight of 13 to 16 ounces per square yard, the filtration screen constructed from a woven fabric including a plurality of parallel warp yarns formed from three pairs of 4 mil to 12 mil monofilament polyamide fibers, the three pairs of fibers twisted together to form a cable yarn, the woven fabric including a plurality of parallel fill yarns, the fill yarns formed from a single 8 mil to 20 mil monofilament polyamide fiber.

12. The method of claim 10 wherein the sheet is a filtration screen and comprising stretching the filtration screen so that it is secured to the target side in a stretched state.

13. A method for manufacturing an archery target comprising:

providing a rigid, structural, freestanding frame including at least one sidewall, a target side and a back side;

securing a sheet to the target side to create an interior compartment bounded by the sheet and the frame;

compressing a fibrous density material, with the compressed density material being located in the compartment and having a density of about 10 to about 14 pounds per cubic foot within the interior compartment;

securing a backing to the back side to retain the fibrous density material within the compartment;

comprising positioning a guide assembly adjacent the frame, and filling the interior compartment and at least a portion of the guide assembly with the density material before said compressing step.

14. The method of claim 10 wherein the sheet is a filtration screen and comprising stapling the filtration screen to the target side of the frame with staples, the staples being aligned in at least two side-by-side rows, wherein staples of one row are staggered relative to the staples of the other row.

15. The method of claim 10 comprising securing a decorative cover to the frame and over a portion of the target side to conceal the sidewalls and the staples.

16. The method of claim 10 wherein the sheet maintains a substantially planar configuration on the target side, countering expanding forces of the density material compressed within the interior compartment.

17. The method of claim 16 wherein the sheet, the backing and the frame form a box shape having a height and a width, the height being greater than the width.

18. An archery target comprising:

a rigid, structural frame including at least one sidewall, a target side and a back side;

a sheet secured to the target side to create an interior compartment bounded by the sheet and the frame, the sheet being adapted to be at least partially penetrated by an arrow traveling at a speed of about 200 to about 400 feet per second, the sheet having a weight of about 10 ounces per square yard to about 25 ounces per square yard, the sheet including a plurality of warp elements and a plurality of weft elements, the warp elements including a plurality of filaments twisted to form a cable;

a density material compressed and being located in the compartment and having a density of about 8 to about 14 pounds per cubic foot within the interior compartment, the density material adapted to prevent the arrow from penetrating the target to an extent that fletchings of the arrow are damaged;

a backing adjacent the density material to retain the density material within the compartment.

19. An archery target comprising:

a rigid, structural, freestanding frame including at least one sidewall, a target side and a back side;

a sheet secured to the target side to create an interior compartment bounded by the sheet and the frame;

a fibrous density material compressed and being located in the compartment and having a density of about 8 to about 14 pounds per cubic foot within the interior compartment;

a backing secured to the back side to retain the fibrous density material within the compartment, wherein the sheet is a filtration screen having a weight of 13 to 16 ounces per square yard, the filtration screen constructed from a woven fabric including a plurality of parallel warp yarns formed from three pairs of 4 mil to 12 mil monofilament polyamide fibers, the three pairs of fibers twisted together to form a cable yarn, the woven fabric including a plurality of parallel fill yarns, the fill yarns formed from a single 8 mil to 20 mil monofilament polyamide fiber.

20. The archery target of claim 18 wherein the sheet is a filtration screen and wherein the filtration screen is secured to the target side in a stretched state with staples that penetrate the frame around a perimeter of the target side, wherein a decorative cover is secured to the frame and over a portion of the target side to conceal the sidewalls and the staples.

21. The archery target of claim 18 wherein the backing is constructed from a woven material that allows the arrow to pass at least partially through the backing.

22. The archery target of claim 18 wherein the sheet and density material cooperatively hold the arrow so that the force required to remove the avow from the target is about 1.5 pounds to about 2.5 pounds.

23. The archery target of claim 18 wherein the plurality of warp elements and weft elements define a plurality of openings therebetween, the openings being openable to allow the arrow to pass at least partially therethrough, the plurality of weft elements and warp elements adapted to come together and at least partially re-close the opening left by the avow after the arrow is removed from the sheet.

* * * * *